US008622617B2

(12) United States Patent
Jeong

(10) Patent No.: US 8,622,617 B2
(45) Date of Patent: Jan. 7, 2014

(54) CONTAINER BAG FOR CONTAINING PARTICULATE MATERIAL

(75) Inventor: Ki Young Jeong, Gyeongsangnam-do (KR)

(73) Assignee: Jeil Industry Co., Ltd., Gyeongsangnam-Do (KR)

( * ) Notice: Subject to any disclaimer, the term of this patent is extended or adjusted under 35 U.S.C. 154(b) by 865 days.

(21) Appl. No.: 12/294,071

(22) PCT Filed: Jun. 15, 2006

(86) PCT No.: PCT/KR2006/002290

§ 371 (c)(1),
(2), (4) Date: Sep. 23, 2008

(87) PCT Pub. No.: WO2007/111399

PCT Pub. Date: Oct. 4, 2007

(65) Prior Publication Data

US 2009/0317024 A1 Dec. 24, 2009

(30) Foreign Application Priority Data

Mar. 24, 2006 (KR) ..... 10-2006-0026957
Apr. 19, 2006 (KR) ..... 10-2006-0035348

(51) Int. Cl.
*B65D 33/02* (2006.01)
*B65D 33/06* (2006.01)

(52) U.S. Cl.
USPC ..... 383/119; 383/105; 383/907; 383/17; 383/19

(58) Field of Classification Search
USPC ..... 383/119, 24, 105, 121, 907, 17, 18, 20
See application file for complete search history.

(56) References Cited

U.S. PATENT DOCUMENTS 3,827,471 A * 8/1974 Gregory et al. ..... 222/181.3
4,901,885 A * 2/1990 Boots ..... 383/119
5,025,925 A * 6/1991 Wiklund ..... 206/386
5,158,367 A * 10/1992 Derby ..... 383/17

(Continued)

FOREIGN PATENT DOCUMENTS

EP 0 635 439 A1 1/1995
JP 07330077 A 12/1995

(Continued)

OTHER PUBLICATIONS

ISA, International Search Report, Nov. 29, 2006.

*Primary Examiner* — Hemant M Desai
*Assistant Examiner* — Gloria R Weeks
(74) *Attorney, Agent, or Firm* — Hershkovitz & Associates, PLLC; Abraham Hershkovitz

(57) ABSTRACT

Disclosed is a container bag for containing particulate materials, which is prevented from being barreled and retained in a stable erect state when contents fill the container bag, whereby the container bag can maximize the loadage of the particulate materials within a limited space with stability. The container bag includes lateral walls, the particulate materials filling an inner space defined by the lateral walls, a bottom wall formed generally in a quadrangle shape and connected to the bottom ends of the lateral walls, a cover connected to the top ends of the lateral walls, and hoops connected to the top ends of the lateral walls, the cover, the lateral walls and the bottom wall being formed from a flexible material, wherein each side of the quadrangle-shaped bottom wall is recessed at the central area thereof.

5 Claims, 11 Drawing Sheets

(56) References Cited

U.S. PATENT DOCUMENTS

| | | | | | |
|---|---|---|---|---|---|
| 5,289,937 | A * | 3/1994 | Boots | 220/9.1 |
| 5,407,090 | A * | 4/1995 | Boots | 220/62.18 |
| 5,458,419 | A * | 10/1995 | Trepte et al. | 383/22 |
| 5,556,205 | A * | 9/1996 | Gallie et al. | 383/24 |
| 5,564,833 | A * | 10/1996 | Proffitt | 383/22 |
| 5,660,478 | A | 8/1997 | Alack et al. | |
| 5,934,807 | A * | 8/1999 | Futerman | 383/105 |
| 6,004,035 | A * | 12/1999 | Hafer et al. | 383/119 |
| 6,113,270 | A * | 9/2000 | Hafer | 383/119 |
| 6,240,709 | B1 * | 6/2001 | Cook | 53/469 |
| 6,287,003 | B1 * | 9/2001 | Hafer | 383/119 |
| 6,416,222 | B2 * | 7/2002 | Hafer | 383/119 |
| 6,491,434 | B2 * | 12/2002 | Hafer | 383/119 |
| 6,739,753 | B2 * | 5/2004 | Richardson et al. | 383/16 |
| 6,921,201 | B2 * | 7/2005 | Richardson et al. | 383/16 |
| 6,935,782 | B2 * | 8/2005 | Cholsaipant | 383/24 |
| 7,086,781 | B2 * | 8/2006 | Richardson et al. | 383/38 |
| 7,156,555 | B2 * | 1/2007 | Richardson et al. | 383/16 |
| 7,427,160 | B2 * | 9/2008 | Richardson et al. | 383/16 |
| 7,476,028 | B2 * | 1/2009 | Richardson et al. | 383/24 |
| 7,600,917 | B2 * | 10/2009 | Richardson et al. | 383/38 |
| 2001/0038720 | A1 * | 11/2001 | Hafer | 383/24 |
| 2002/0008517 | A1 * | 1/2002 | Derby et al. | 324/318 |
| 2003/0123757 | A1 * | 7/2003 | Cholsaipant | 383/24 |
| 2004/0264814 | A1 * | 12/2004 | Eisenbarth et al. | 383/32 |
| 2005/0100248 | A1 * | 5/2005 | Chang | 383/21 |
| 2005/0129336 | A1 * | 6/2005 | Richardson et al. | 383/16 |
| 2006/0104546 | A1 * | 5/2006 | Combes | 383/38 |
| 2007/0127852 | A1 * | 6/2007 | Town et al. | 383/16 |
| 2008/0310766 | A1 * | 12/2008 | Plunkett et al. | 383/22 |
| 2010/0021088 | A1 * | 1/2010 | Wilfong, Jr. | 383/23 |

FOREIGN PATENT DOCUMENTS

| | | | |
|---|---|---|---|
| JP | 2004-149160 | A | 5/2004 |
| KR | 1020040027809 | | 1/2004 |
| US | 5 558 137 | A | 9/1996 |
| US | 5 758 973 | A | 6/1998 |
| WO | 9709244 | A1 | 3/1997 |

* cited by examiner

Fig.16

| Items | Inventive Bag | Cylindrical Bag | Prismatic Bag | Purpose of Testing |
|---|---|---|---|---|
| Specification of Bag | 900X900X1100H | 1160X1100H | 900X900X1100H | • Ordinary P.P 500KG Loading Specification |
| Contents for Testing | P.P 500KG | P.P 500KG | P.P 500KG | • Contents for Testing |
| Specification After Filling | 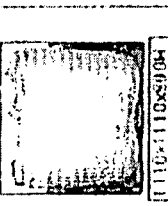 1110x1110x900H | 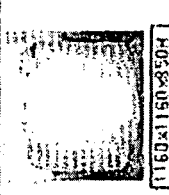 1160x1160x850H | 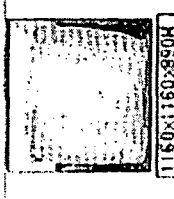 1160x1160x950H | • Y120A GRADE (Available from Honam Petrochemical Corp.) |
| Downward Deformation (Sagging Phenomenon) |  45mm |  150mm |  120mm | • 안정성 확인: Confirming Stability<br>① Inventive Bag: Forming 4 pillars<br>② Cylindrical Bag: Forming 1 pillar<br>③ Prismatic Bag: Forming 1 pillar |
| Maximum Anti-Inversion Force |  147kg |  127kg |  122kg | Confirming stability at multi-layered filing-up |
| Comparison After Filling |  1110x1110 |  1160X1160 |  1160X1160 | • Comparison of Barreling Phenomenon |
| Loading Space | 2.22X2.22=4.93m² | 2.32X2.32=5.38m² | 2.32X2.32=5.38m² | • Investigating Spatial Usage (Percentage of Void) |
| Loadage | P.P 2000KG | P.P 2000KG | P.P 2000KG | • Data for Specification After Filling x 4 |

CONTAINER BAG FOR CONTAINING PARTICULATE MATERIAL

CROSS-REFERENCE TO RELATED APPLICATIONS

This application claims priority to PCT/KR2006/002290 filed on Jun. 15, 2006; which claims priority of Korean Application No. 10-2006-0026957, filed Mar. 24, 2006 and Korean Application No. 10-2006-0035348, filed Apr. 19, 2006.

TECHNICAL FIELD

The present invention relates to a container bag, and in particular to a container bag for containing particulate materials, wherein the container bag is retained in a stable erect state without being barreled when contents fill the container bag, thereby maximizing loadage in a limited space with stability.

BACKGROUND ART

In general, a container bag means an industrial sack for use in transportation and storage of grains, powders, or the like, wherein such a container bag is fabricated using a foldable and flexible material and referred to as FIBC (flexible intermediate bulk container), big bag or bulk bag.

Since a container bag usually contains about 500 to 2,000 Kg of chemicals, minerals, grains, plastic products, cement or the like, it is often transported by a crane or a hoist forklift truck so as to be stored in a warehouse, or loaded on and transported by a truck.

Recently, as the quantity of goods transported has increased due to active internal trade, demand for container bags, which are stable at the time of being transported by a truck or a container vehicle or stacked in a warehouse and allow the efficient use of a space, has increased.

The above-mentioned container bag has a space for receiving contents, wherein the space is defined by a bottom wall, lateral walls and a cover, the bottom wall and the cover having openings for introducing contents into the container bag and discharging the contents from the container bag, respectively. In addition, the container bag has loops, which are distributed around the top ends of the lateral walls so as to allow the container bag to be transported by a transportation means, the loops being formed of a transportation rope or a belt.

Such a container bag is usually formed by weaving a natural fabric material or a synthetic resin material such as PVC (polyvinyl chloride), polypropylene and polyethylene in such a manner as to retain the external appearance as well as the strength of the container bag, and if desired, the container bag may be lined with an inside skin which is formed from a water-proof vinyl material.

Therefore, the external appearance of the container bag is easily deformable and foldable because it is formed from a flexible material, whereby it can be stored in a minimized status in volume when no content is contained therein. In addition, when contents fill the container bag for transportation, the container bag takes a form, which allows a maximum quantity of freight to be loaded within a predetermined space so as to reduce the freight transportation costs.

A cylindrical or square pillar type container bag is usually used for such a container bag. FIG. 1 shows photographs of a conventional cylindrical pillar type container bag and a conventional square pillar type container, respectively.

The cylindrical pillar type container bag has an advantage in that it can receive the largest amount of materials as compared with any other type of container bags having the same surface area. However, it has a problem in that when a plurality of such cylindrical pillar type container bags are loaded within a limited space, it is difficult to efficiently use the space because the percentage of void (empty space between bags) is very high.

Meanwhile, the square pillar type container bag is advantageous in view of the spatial usage when a plurality of container bags are loaded within a limited space on a transportation vehicle. However, when such a container bag contains contents, the vertical intermediate areas of the lateral walls are caused to be bulged out (hereinafter, to be referred to as "barreling phenomenon") due to the self-weight of the contents, and the container bag is deformed substantially in a cylindrical shape like a cylindrical pillar type container bag, whereby the container bag occupies a large space when it is transported or stored.

Recently, automated warehouses have been largely used for storing container bags in a stacked state, wherein in such automated houses, each container bag is palletized, transported by a forklift truck, and stored on a support die, which is properly partitioned lengthwise and crosswise. However, there is a problem in that due to the barreling phenomenon, the width of the support die does not correspond with that of the container bags, whereby it is difficult to stack the container bags.

Various researches have been made in order to solve the problems caused when using conventional container bags. As a result, there has been provided a method for suppressing the barreling phenomenon by forming reinforcing areas in the vertical or crosswise direction on the container bags. With this method, although the barreling phenomenon may be suppressed to a certain extent, this method has problems in that due to the formation of the reinforcing areas, the manufacturing costs are increased, and due to the loads concentrated adjacent to the reinforcing areas, the container bags get torn.

There has been also provided a method for suppressing the barreling phenomenon by sewing partitions to inner walls laterally adjacent to the respective vertical corners of a square pillar type container bag in such a manner that each partition interconnects two adjacent inner walls. However, this method has a problem in that due to the formation of partitions, the manufacturing costs are increased. Furthermore, foreign matters occurring at the time of manufacturing the partitions are mixed with the contents received in the container bag, which may cause the rejection of products contained in the container bag. Moreover, the method has a disadvantage in that as being obstructed by the partitions, it is impossible to use a water-tight inside skin. In particular, there is a problem in that when a plurality of container bags are stacked, the lowermost container bag or bags may experience fracture at the partition-connected areas, whereby the stability is deteriorated.

DISCLOSURE OF THE INVENTION

Technical Problem to be Solved

Therefore, the present invention has been made in view of the above-mentioned problems, and it is an object of the present invention to provide a container bag for containing particulate materials, wherein the container bag is capable of retaining a stable erect state without being barreled when contents fill the container bag, so that when a plurality of such container bags are loaded in multiple layers, they can be stacked with stability, thereby maximizing loadage within a limited space.

Technical Means for Solving the Problem

According to an aspect of the present invention, there is provided a container bag for containing particulate materials including lateral walls, the particulate materials filling an inner space defined by the lateral walls, a bottom wall formed generally in a quadrangle shape and connected to the bottom ends of the lateral walls, a cover connected to the top ends of the lateral walls, and hoops connected to the top ends of the lateral walls, the cover, the lateral walls and the bottom wall being formed from a flexible material, wherein each side of the quadrangle-shaped bottom wall is recessed at the central area thereof.

According to another aspect of the present invention, there is provided a container bag for containing particulate materials including lateral walls, the particulate materials filling an inner space defined by the lateral walls, a bottom wall formed generally in a quadrangle shape and connected to the bottom ends of the lateral walls, a cover connected to the top ends of the lateral walls, and hoops connected to the top ends of the lateral walls, the cover, the lateral walls and the bottom wall being formed from a flexible material, wherein the bottom side of a quadrangle shape of each lateral wall, which is adjacent to the bottom wall, is recessed at the central area thereof.

According to another aspect of the present invention, there is provided a container bag for containing particulate materials including lateral walls, the particulate materials filling an inner space defined by the lateral walls, a bottom wall formed generally in a quadrangle shape and connected to the bottom ends of the lateral walls, a cover connected to the top ends of the lateral walls, and hoops connected to the top ends of the lateral walls, the cover, the lateral walls and the bottom wall being formed from a flexible material, wherein each side of the quadrangle-shaped bottom wall is recessed at the central area thereof and the bottom side of the quadrangle shape of each lateral wall, which is adjacent to the bottom wall, is recessed at the central area thereof.

The cover, the lateral walls, and the bottom wall may be formed from any one selected from a group consisting of natural fiber, synthetic fiber, synthetic fiber cloth and laminated synthetic resin film.

In addition, the cover may be formed in a quadrangle shape, a circular shape or a duffle shape.

According to a preferred embodiment of the present invention, the bottom wall is formed in a four-leaf clover, which is defined by outlines of four circular segments adjacent to each other.

According to another preferred embodiment of the present invention, each lateral wall has a reinforcement strap which is extended from the top end to the bottom end of the lateral wall through the center of the lateral wall, and the loops are connected to the top ends of two adjacent reinforcement straps, respectively.

According to another preferred embodiment of the present invention, the ratio of the depth of a recess formed in the bottom wall and the length of a corresponding side of an imaginary quadrangle circumscribing the bottom wall is defined to be in a range of 0.02:1 to 0.25:1, when the depth is measured from the corresponding side of the imaginary quadrangle.

According to another preferred embodiment of the present invention, the ratio of the depth of a recess formed in the bottom side of each lateral wall and the length of a corresponding side of an imaginary quadrangle circumscribing the lateral wall is defined to be in a range of 0.02:1 to 0.25:1, when the depth is measured from the corresponding side of the imaginary quadrangle.

According to another embodiment of the present invention, each lateral wall is formed by cutting a cylindrical cloth or sewing a plurality of flat cloths, and each area straightly interconnecting a loop-connected portion and a corresponding recess in the bottom wall or lateral walls is formed in a double-layered structure.

Effect of the Invention

According to the inventive container bag for containing particulate materials, each side of the quadrangle shape of the bottom wall is recessed at the central area thereof or at least one of top or bottom sides of each lateral wall is recessed at the central area thereof. As a result, the container bag can be retained in a stable erect state without being barreled when contents fill the container bag, whereby a plurality of container bags can be stacked in multiple layers, thereby maximizing loadage within a limited space.

Accordingly, if the inventive container bags for containing 1,000 Kg of particulate materials instead of conventional container bags for containing 750 Kg of particulate materials, which are currently used mainly for an automated warehouse, the loading efficiency can be increased about 33.3%. When particulate materials are loaded on a freight car, conventional 750 Kg container bags are stacked in two layers. However, if the inventive container bags are used, it is possible to stack 1,000 kg container bags in two layers or to stack 1,500 kg container bags in one layer, whereby the loading efficiency for transportation can be enhanced.

FIG. 16 illustrates a table indicating the results of testing the inventive container bags, and conventional cylindrical pillar type and square pillar type container bags.

The test was made so as to investigate and confirm the barreling phenomenon, downward sagging phenomenon, maximum anti-inversion force, and required loading space, wherein the loading space was tested considering the areas occupied by the container bags because the inventive container bags can be stacked in multiple layers.

From the testing results, it can be appreciated that the inventive container bags are substantially superior to the conventional cylindrical pillar type and square pillar type container bags.

In particular, the inventive container bags show remarkable superiority in terms of the downward sagging phenomenon, which is a barometer indicating the stability in stacking container bags in multiple layers. This means that the inventive container bags take a stable construction when contents fill them because the load of contents is dispersed outward without being biased to the central area.

BRIEF DESCRIPTION OF THE DRAWINGS

The foregoing and other objects, features and advantages of the present invention will become more apparent from the following detailed description when taken in conjunction with the accompanying drawings in which:

FIG. 16 illustrates a table showing the results of testing the characteristics of the inventive container bag, a conventional cylindrical pillar type container bag, and a conventional square pillar type container bag.

BEST MODE FOR CARRYING OUT THE INVENTION

Reference will now be made in detail to the preferred embodiments of the present invention.

Figure 1:
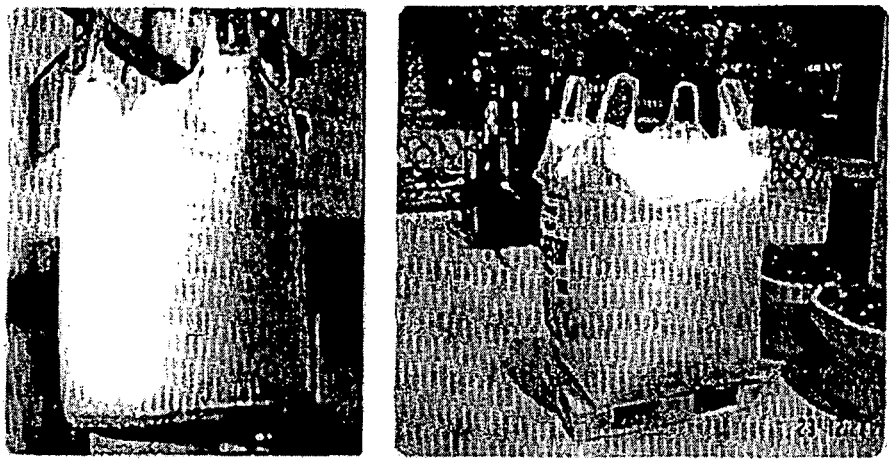
FIG. 1 illustrates photographs showing a conventional cylindrical pillar type container bag and a conventional square pillar type container, respectively.
Figure 2:
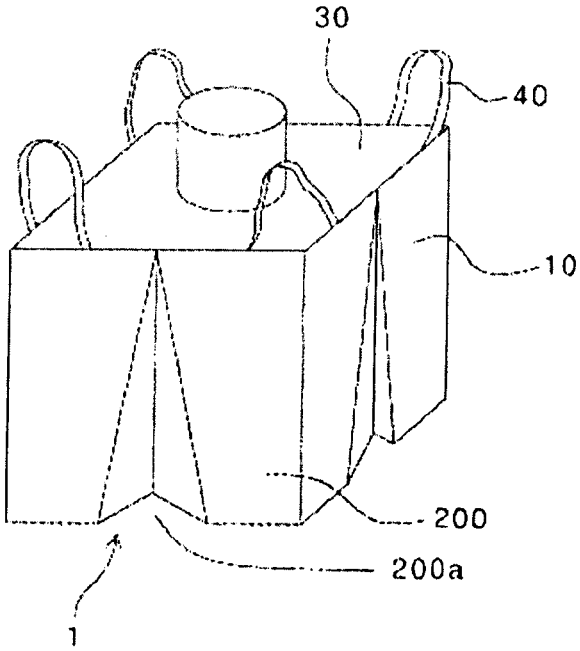
FIG. 2 illustrates a perspective view showing a container bag for containing particulate materials according to an embodiment of the present invention.
Figure 3:
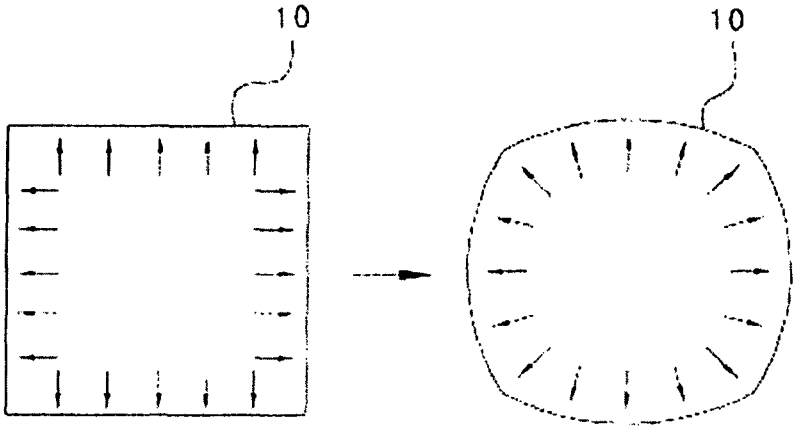
FIG. 3 illustrates views showing, in horizontal cross-section, a conventional square pillar type container bag before and after contents fill the container bag.

FIG. 2 illustrates a perspective view showing a container bag for containing particulate materials according to an embodiment of the present invention, and FIG. 3 illustrates views showing, in horizontal cross-section, a conventional square pillar type container bag before and after contents fill the container bag.

As shown in FIG. 2, a container bag 1 for containing particulate materials according to an embodiment of the present invention includes a plurality of lateral walls 10, a bottom wall 200, a cover 30, and a plurality of loops 40, wherein the lateral walls 10, the cover 30 and the loops 40 are the same in construction with those of the prior art. Therefore, a detailed description thereof is omitted in order to avoid overlapped description, and newly added components are described in detail in terms of the actions thereof.

In general, when pressure is applied to the inner walls of a container bag, the container bag tends to take on a cylindrical shape in cross-section so as to secure a maximum volume while retaining the surface area thereof constant. That is, as shown in FIG. 3, the quadrangle shape defined by the lateral walls when the lateral walls are viewed in horizontal cross-section, generally tends to be turned into a circular shape so as to secure a maximum area without being changed in total length by the pressure (indicated by arrows) applied to the inner walls when contents fill the container bag.

Therefore, when contents fill a square pillar type container bag, a barreling phenomenon occurs as shown in FIG. 3. Such a barreling phenomenon is seriously produced, in particular at the central area of the container bag in the vertical direction because the pressure applied to the inner walls is increased when approaching the bottom wall due to the self-weight of the contents contained in the container bag.

Meanwhile, even if the pressure causing the barreling phenomenon is increased when approaching the quadrangle-shaped bottom wall, the horizontal cross-section of the lateral walls can do nothing but hold the form of the bottom wall. As a result, the horizontal cross-section of the lateral walls is retained generally in a quadrangle shape when approaching the lower end of the container bag.

Figure 4:
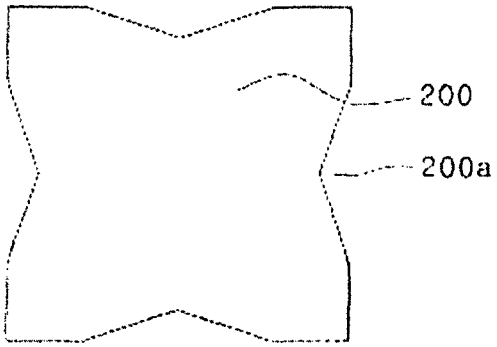
FIG. 4 illustrates a schematic view showing a bottom wall of a container bag for containing particulate materials according to an embodiment of the present invention.

FIG. 4 illustrates a schematic view showing a bottom wall of a container bag for containing particulate materials according to an embodiment of the present invention.

As shown in FIG. 4, the bottom wall 200 of the container bag is formed in a quadrangle shape with each side of the quadrangle shape being recessed at the central area 200*a* thereof.

The pressure, which is produced by the self-weight of the contents in the container bag and causes the barreling phenomenon, is increased when approaching the lower end of the container bag as described above and the deformation caused by the pressure is most serious at the central area of each side of the quadrangle shape defined by the lateral walls when viewed in horizontal cross-section. Therefore, it is possible to suppress the barreling phenomenon if the bottom wall 200 is formed in a quadrangle shape with each side of the quadrangle shape being recessed at the central area 200*a* thereof.

Figure 5:
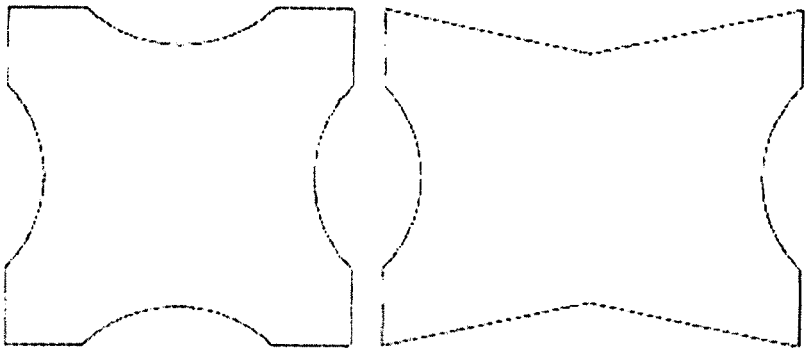
FIG. 5 illustrates schematic views showing other embodiments of the present invention.

FIG. 5 illustrates schematic views showing other embodiments of the present invention.

As shown in FIG. 5, the present invention suppresses the barreling phenomenon by forming recesses in the bottom wall or the lateral walls, which correspond to the most seriously barreled areas in a square pillar type container bag. Therefore, the present invention can be modified in various forms.

Figure 6:
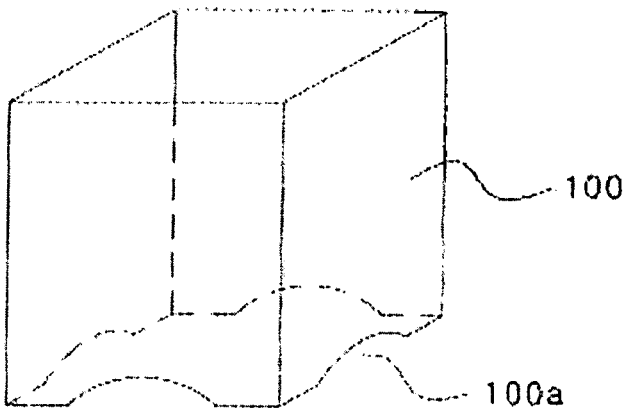
FIG. 6 illustrates a perspective view showing lateral walls of a container bag for containing particulate materials according to another embodiment of the present invention.

FIG. 6 illustrates a perspective view showing lateral walls of a container bag for containing particulate materials according to another embodiment of the present invention.

A container bag for containing particulate materials according to the present embodiment includes a plurality of lateral walls, a bottom wall, a cover, and a plurality of loops, wherein the lateral walls, the cover and the loops are the same in construction with those of the prior art. Therefore, a detailed description thereof is omitted in order to avoid overlapped description, and newly added components are described in detail in terms of the actions thereof.

As shown in FIG. 6, each of the lateral walls 100 of the container bag for containing particulate materials according to the present embodiment includes a recess formed at the central area 100*a* of the bottom side of a quadrangle shape of each lateral wall 100, which is adjacent to the bottom wall (which is formed in a square or circular shape).

The principle for preventing the barreling phenomenon according to the present invention as described above is identically applied to the case in which the recesses are formed at the bottom side of a quadrangle shape of each lateral wall as well as at each side of the bottom wall.

A container bag for containing particulate materials according to another embodiment of the present invention includes a plurality of lateral walls, a bottom wall, a cover, and a plurality of loops, wherein the lateral walls, the cover and the loops are the same in construction with those of the prior art. Therefore, a detailed description thereof is omitted in order to avoid overlapped description, and newly added components are described in detail in terms of the actions thereof.

The container bag for containing particulate materials according to the present embodiment includes a recess at the central area of a bottom side of a quadrangle shape of each lateral wall, which is adjacent to the bottom wall (which is formed in a square or circular shape).

It is natural that the principle for preventing the barreling phenomenon according to the present invention as described above is identically applied to the case in which a recess is formed at the central area of the bottom side of a quadrangle shape of each lateral wall, wherein the bottom side is adjacent to the bottom wall.

According to the present embodiment, the cover 30, the lateral walls 100 and the bottom wall 200 are preferably formed from any one selected from a group consisting of natural fiber, synthetic fiber, synthetic fiber cloth or laminated synthetic resin film. As employing those flexible materials, the external appearance of such a container bag can be easily deformed, thereby allowing the container bag to be stored in a minimized status in volume when no content is contained in the container bag.

A container bag according to another embodiment, the cover of the container bag may be formed in a circular shape, a quadrangle shape or a duffle shape. The duffle shape means a cylindrical pillar shape, the top end of which is opened.

Figure 7:
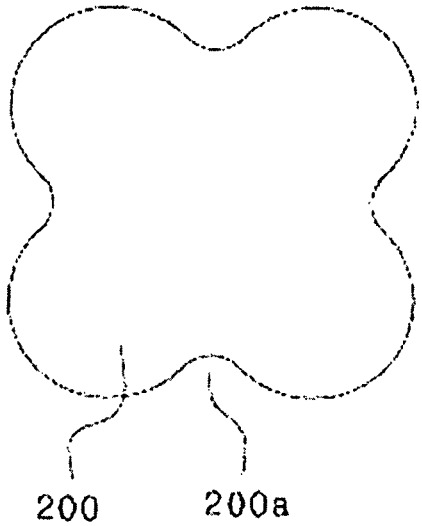
FIG. 7 illustrates a schematic view showing a bottom wall of a container bag for containing particulate materials according to another embodiment of the present invention.
Figure 8:
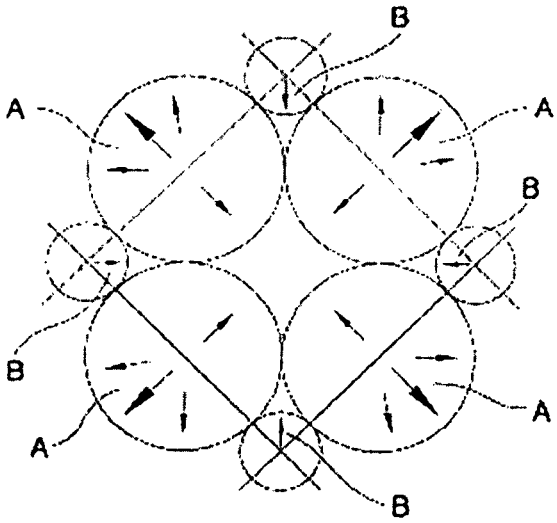
FIG. 8 illustrates a schematic view for describing forces applied to the lateral walls adjacent to the bottom wall of a container bag according to an embodiment of the present invention in a state in which contents fill the container bag.
Figure 9:
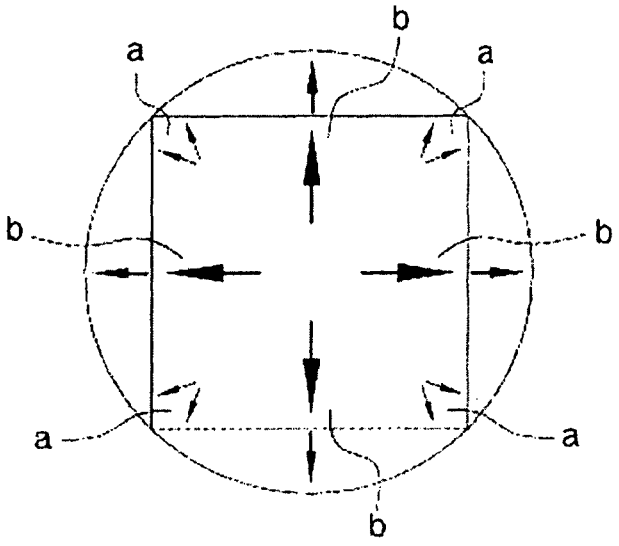
FIG. 9 illustrates a schematic view for describing forces applied to the lateral walls adjacent to the bottom wall of a conventional square pillar type container bag in a state in which contents fill the container bag.

FIG. 7 illustrates a schematic view showing a bottom wall of a container bag for containing particulate materials according to another embodiment of the present invention, FIG. 8 illustrates a schematic view for describing forces applied to the lateral walls adjacent to the bottom wall of a container bag according to an embodiment of the present invention in a state in which contents fill the container bag, and FIG. 9 illustrates a schematic view for describing forces applied to the lateral walls adjacent to the bottom wall of a conventional square pillar type container bag in a state in which contents fill the container bag.

According to another embodiment of the present invention, the bottom wall of the container bag may be formed in a four-leaf clover shape, which has the outlines of four circular segments adjacent to each other.

The four-leaf clover shape is formed by outlines of four circular segments adjacent to each other with recesses 200*a*, each of which is formed between two adjacent outlines of circular segments through a rounding treatment.

As shown in FIG. 8, when contents fill the container bag, the container bag according to the present invention takes a form in which four imaginary circular pillar type container bags "A" are formed adjacent to each other and the circular pillars are surrounded by lateral walls.

As shown in FIG. 9, in a conventional square pillar type container bag, due to the barreling phenomenon, contents do not fully fill the corner areas "a" of the container bag but excessively fill the areas "b" between the corner areas "a". As a result, the corner areas of the bottom wall cannot properly support the load applied to the container bag, whereby the stability of the container bag is deteriorated.

However, according to the present embodiment, because each of the corner areas "a" of the container bag is formed substantially in a shape of a circular segment in horizontal cross-section, so that contents fully fill the corner areas, whereby a ground, on which the container bag is laid, and the bottom wall 200 are adapted to be in contact with each other over a more wide area, thereby assuring a stable construction.

Therefore, in a state in which contents fill the container bag, the load applied to the container bag is dispersed to and supported by the outer-most areas thereof, which allows a plurality of container bags to be stacked in multiple layers. In addition, because each side of the quadrangle shape of the bottom wall is recessed at the central area thereof or the bottom side of the quadrangle shape of each lateral wall is recessed at the central area thereof, the barreling phenomenon is suppressed by the tension applied to the "B" areas, whereby the container bag is generally retained in the square pillar shape. As a result, when a plurality of container bags are loaded in a container, a transportation vehicle or the like, the inventive container bag has a more advantageous effect in view of spatial usage as compared to a conventional cylindrical pillar type container.

Figure 10:
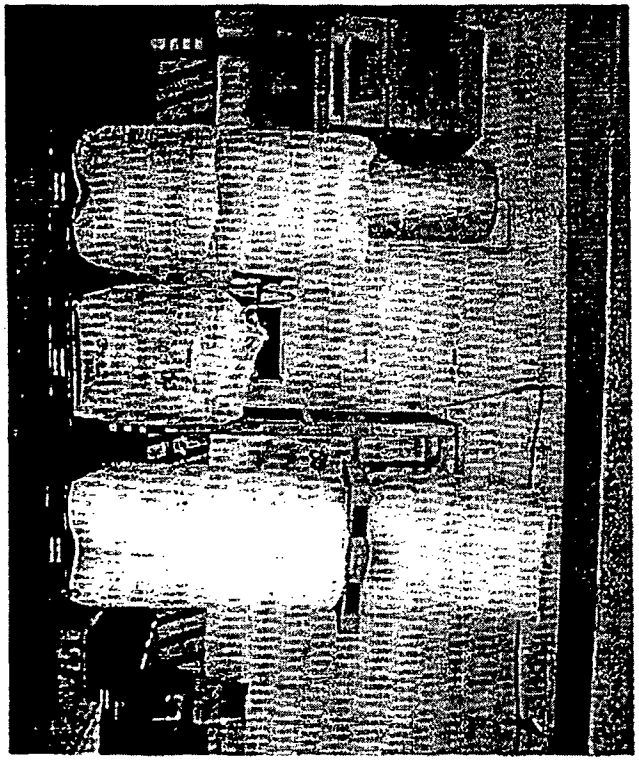
FIG. 10 illustrates a photograph showing conventional square pillar type container bags and the inventive container bags, in a state in which contents fill the container bags.
Figure 11:
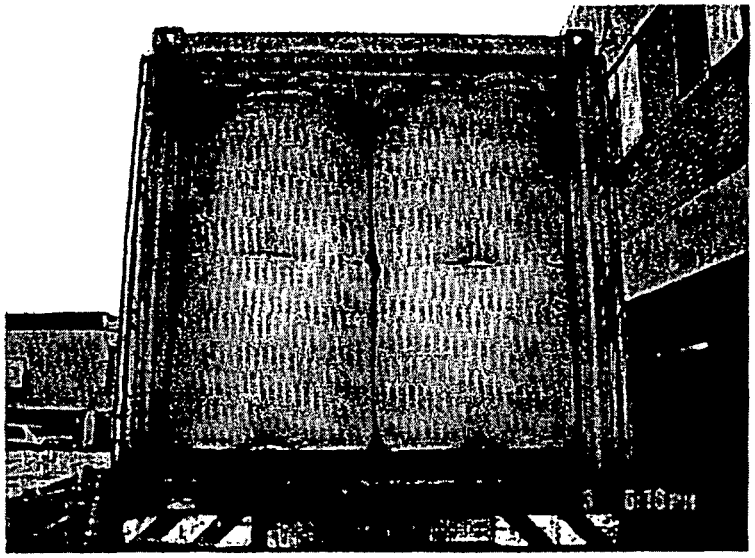
FIG. 11 illustrates a photograph showing the inventive container bags stacked in two layers in a container.

FIG. 10 illustrates a photograph showing conventional square pillar type container bags and the inventive container bags, in a state in which contents fill the container bags, and FIG. 11 illustrates a photograph showing the inventive container bags stacked in two layers in a container.

In the photograph of FIG. 10, the centrally positioned container bag is a conventional square pillar type container bag, and the container bags positioned at left and right sides are the inventive container bags. As can be seen from FIG. 10, the inventive container bags can be stably stacked in multiple layers.

As can be seen from FIG. 11, the inventive container bags are retained substantially in a square pillar shape when contents fill the container bags, which is advantageous in view of spatial usage when they are loaded in a transportation vehicle or the like.

Figure 12:
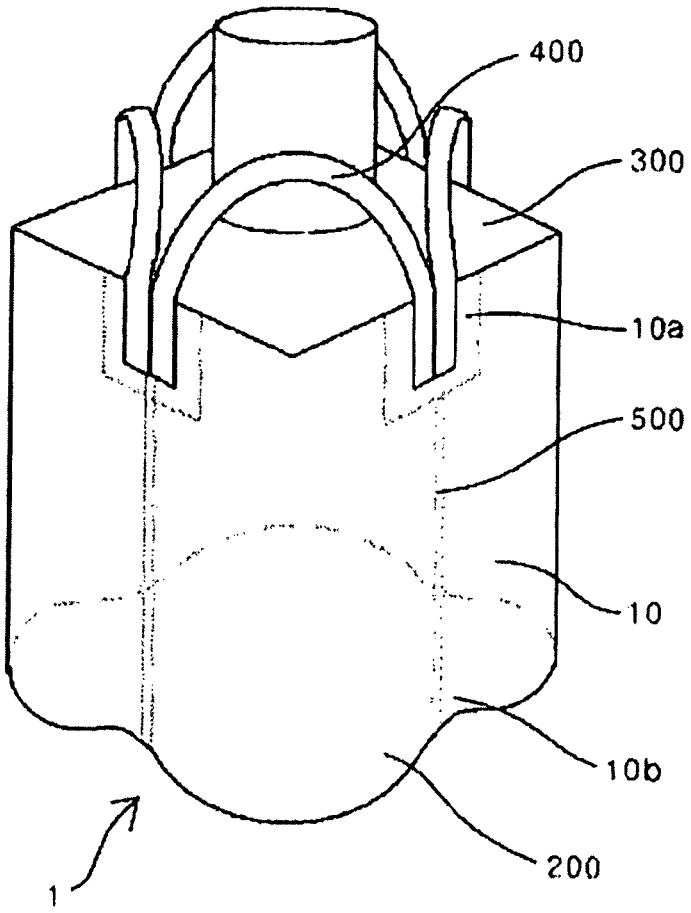
FIG. 12 illustrates a perspective view showing a container bag for containing particulate materials according to another embodiment of the present invention.

FIG. 12 illustrates a perspective view showing a container bag for containing particulate materials according to another embodiment of the present invention.

According to the present embodiment, the lateral walls are provided with reinforcement straps, each strap extending vertically through the center of the corresponding lateral wall, and loops are formed, each loop being connected to the top end portions of two adjacent reinforcement straps.

As the reinforcement straps 500 are formed as shown in FIG. 12, the barreling phenomenon is more efficiently suppressed, so that the container bag can be retained in the erect state when contents fill the container bag.

With this construction, the inventive container bag can be increased in tensile strength against the load applied at the time of transporting the container bag and contents can more completely fill each corner area of the container bag.

Meanwhile, because the inventive container bag takes a construction which allows arms (not shown) of a forklift truck to be easily inserted into the loops 300 when the container bag is loaded for transportation or storage, it is also possible to save labor power.

Figure 13:
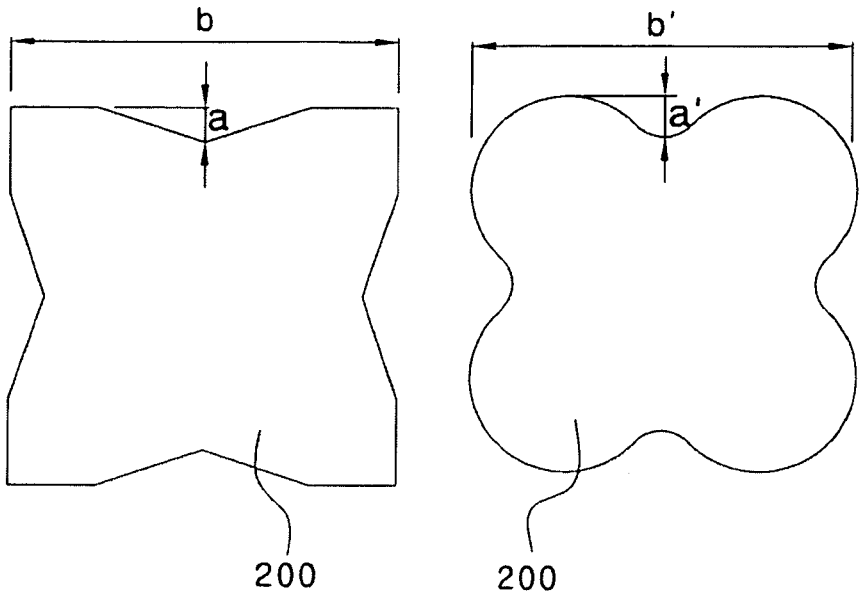
FIG. 13 illustrates a schematic view for describing the features of a bottom wall of a container bag for containing particulate materials according to another embodiment of the present invention.

FIG. 13 illustrates schematic views for describing the features of a bottom wall of a container bag for containing particulate materials according to another embodiment of the present invention.

According to the present embodiment, the bottom wall has recesses, wherein the ratio of the depth of each recess from an imaginary quadrangle circumscribing the bottom wall and the length of each side of the imaginary quadrangle is determined to be in the range of 0.02:1 to 0.25:1.

That is, according to the present embodiment, it is preferable that the ratio (a:b or a':b') of the depth (a or a') from the imaginary quadrangle circumscribing the bottom wall and the length (b or b') of each side of the imaginary quadrangle is in the range of 0.02:1 to 0.25:1.

As shown in FIG. 13, the inventive container bag can be embodied in various forms, wherein the feature of the inventive bottom wall is that the bottom wall is recessed from each side of the imaginary quadrangle circumscribing the bottom wall.

The specification of the recesses, which is a characteristic feature of the present invention, can be determined by taking an imaginary quadrangle circumscribing the bottom wall and measuring the depth (a or a') of the recesses from each side of the imaginary quadrangle. That is, the recesses can be represented by the ratio (a:b or a':b') of the depth (a or a') of the recesses of the bottom wall and the length of each side of the imaginary quadrangle (b or b') circumscribing the bottom wall.

As the ratio is increased, the effect of suppressing the barreling effect and enhancing the stability can be increased. If so, however, the amount of contents received by the container bag is reduced. Therefore, the ratio is preferably determined to be in the range of 0.20:1 to 0.25:1.

Figure 14:
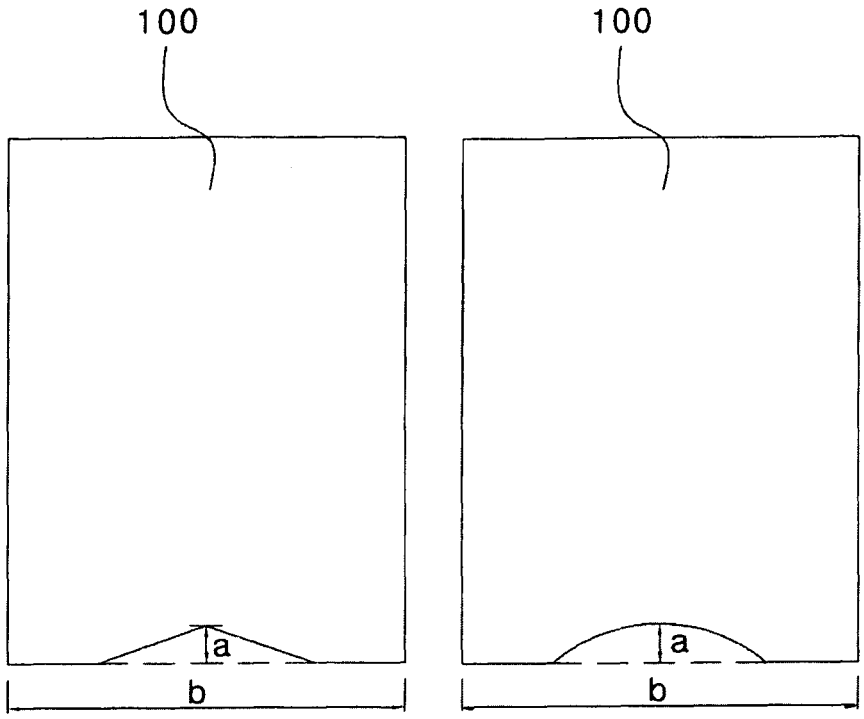
FIG. 14 illustrates a schematic view for describing the features of side views of a container bag for containing particulate materials according to another embodiment of the present invention.

FIG. 14 illustrates a schematic view for describing the features of side views of a container bag for containing particulate materials according to another embodiment of the present invention.

As shown in FIG. 14, according to the present embodiment, each lateral wall has a recess, wherein the ratio of the depth (a or a') of the recess from an imaginary quadrangle circumscribing the lateral wall and the length (b or b') of each side of the imaginary quadrangle is determined to be in the range of 0.02:1 to 0.25:1.

As the ratio is increased, the effect of suppressing the barreling effect and enhancing the stability can be increased as described above. If so, however, the amount of contents received by the container bag is reduced. Therefore, the ratio is preferable determined to be in the range of 0.20:1 to 0.25:1.

Figure 15:
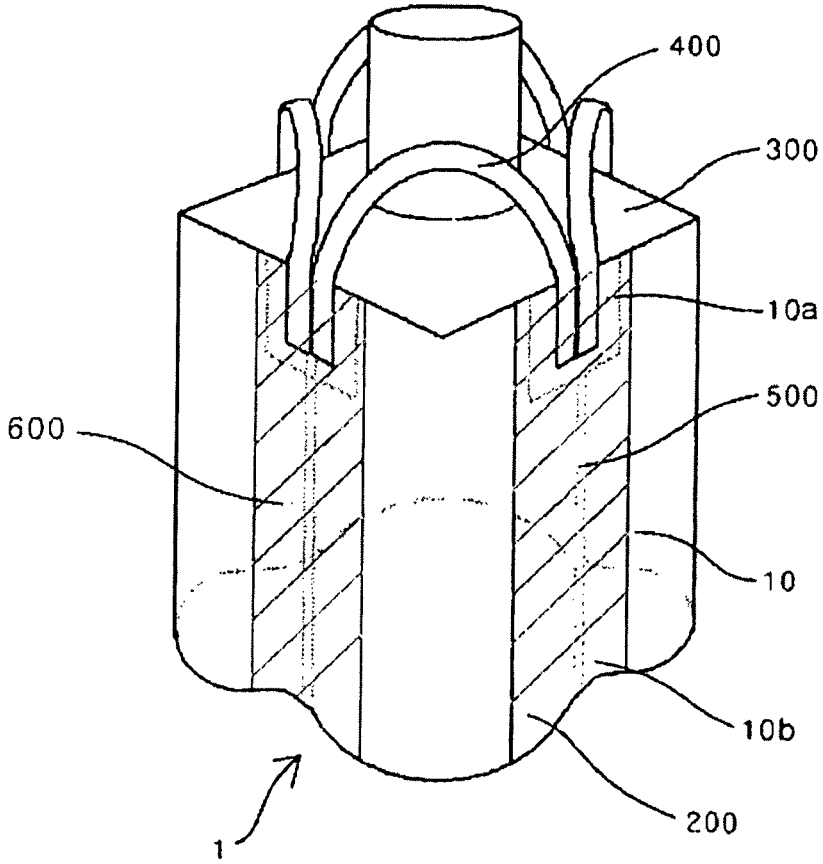
FIG. 15 illustrates a perspective view showing a container bag for containing particulate materials according to another embodiment of the present invention.

FIG. 15 illustrates a perspective view showing a container bag for containing particulate materials according to another embodiment of the present invention.

According to the present embodiment, it is preferable that a lateral wall of the container bag is formed by cutting a cylindrical cloth or sewing a plurality of flat cloths and the areas straightly interconnecting the loop-connected areas and the recesses of the bottom area are formed in a double-layered structure.

In the prior art, each of the lateral walls 10 has been formed by cutting an elongated cylindrical cloth or sewing a plurality of flat cloths. Because considerable tension is applied to the areas for suppressing the barreling of the lateral walls 10 of the container bag, according to the present embodiment, the areas 600 straightly interconnecting the hoop-connected areas 10*a* and the recesses 10*b* of the bottom wall are formed in a double-layered structure, thereby enduring the tension.

INDUSTRIAL APPLICABILITY

As can be seen from the foregoing, according to the present invention there is provided a container bag which is not barreled even if contents such as granules, powders or the like, fill the container bag, and which is prevented from being barreled to a maximum extent even if such container bags are stacked in multiple layers, thereby being efficiently and stably loaded in a limited space such as a container or a warehouse.

While the present invention has been described in connection with what is presently considered to be the most practical and preferred embodiment, it is to be understood that the invention is not limited to the disclosed embodiment and the drawings, but, on the contrary, it is intended to cover various modifications and variations within the spirit and scope of the appended claims.

The invention claimed is:

1. A container bag for containing particulate materials, the container bag comprising lateral walls, the particulate materials filling an inner space defined by the lateral walls, a bottom wall formed generally in a quadrangle shape and connected to bottom ends of the lateral walls, a cover connected to top ends of the lateral walls, and loops attached at the top ends of the lateral walls, wherein the cover, the lateral walls and the bottom wall are formed from a flexible material, wherein each side of the quadrangle bottom wall is recessed at a central area thereof and a bottom side of the quadrangle shape of each lateral wall is recessed at the central area thereof, wherein each lateral wall has a reinforcement strap which is extended from the top end to the bottom end of the lateral wall through a center of the lateral wall, and the loops are attached at the top ends of two adjacent reinforcement straps, respectively, and wherein recesses bordering between the bottom wall and the lateral wall form areas straightly interconnecting the top ends of the reinforcement straps and the loops, and the areas that straightly interconnect the top ends of the reinforcement straps and the loops are formed in a double-layered structure, wherein a ratio of a depth of a recess formed in the bottom wall and a length of a corresponding side of an imaginary quadrangle circumscribing the bottom wall is defined to be in a range of 0.02:1 to 0.25:1, when the depth is measured from the corresponding side of the imaginary quadrangle, and wherein a ratio of a depth of a recess formed in the lateral wall and a length of a corresponding side of an imaginary quadrangle circumscribing the lateral wall is defined to be in a range of 0.02:1 to 0.25:1, when the depth is measured from the corresponding side of the imaginary quadrangle.

2. The container bag as claimed in claim 1, wherein the cover, the lateral walls, and the bottom wall are formed from any one selected from a group consisting of natural fiber, synthetic fiber, synthetic fiber cloth and laminated synthetic resin film.

3. The container bag as claimed in claim 2, wherein the cover is formed in a quadrangle shape, a circular shape or a duffle shape.

4. The container bag as claimed in claim 1, wherein the bottom wall is formed in a four-leaf clover, which is defined by outlines of four circular segments adjacent to each other.

5. The container bag as claimed in claim 1, wherein each lateral wall is formed by cutting a cylindrical cloth or sewing a plurality of flat cloths.

* * * * *

UNITED STATES PATENT AND TRADEMARK OFFICE

CERTIFICATE OF CORRECTION

PATENT NO. : 8,622,617 B2
APPLICATION NO. : 12/294071
DATED : January 7, 2014
INVENTOR(S) : Ki Young Jeong It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 908 days.

Signed and Sealed this
Twenty-second Day of September, 2015

Michelle K. Lee

Michelle K. Lee
*Director of the United States Patent and Trademark Office*